US006293198B1

(12) United States Patent
Mizuno

(10) Patent No.: US 6,293,198 B1
(45) Date of Patent: Sep. 25, 2001

(54) CIRCULATION TREATMENT SYSTEM AND METHOD FOR TREATING FOUNTAIN SOLUTION

(75) Inventor: Seiichi Mizuno, Fukuoka-ken (JP)

(73) Assignee: S. T. Engineering Co., Ltd., Fukuoka-ken (JP)

( * ) Notice: Subject to any disclaimer, the term of this patent is extended or adjusted under 35 U.S.C. 154(b) by 0 days.

(21) Appl. No.: 09/687,302

(22) Filed: Oct. 13, 2000

(51) Int. Cl.[7] ..... B41L 47/60
(52) U.S. Cl. ..... 101/483; 101/424
(58) Field of Search ..... 101/483, 424, 101/148, 147, 130, DIG. 45

(56) References Cited

U.S. PATENT DOCUMENTS 4,211,541 * 7/1980 Fernandez ..... 55/68
4,293,416 * 10/1981 Keoteklian ..... 210/208
5,017,291 * 5/1991 Semler et al. ..... 101/366
5,085,784 * 2/1992 Ostricher ..... 210/767
5,181,467 * 1/1993 Takekoshi ..... 101/147
5,335,596 * 8/1994 DeMoore et al. ..... 101/147
5,415,091 * 5/1995 Junghans ..... 101/147

* cited by examiner

*Primary Examiner*—John S. Hilten
*Assistant Examiner*—Anthony H. Nguyen
(74) *Attorney, Agent, or Firm*—Jordan and Hamburg LLP

(57) ABSTRACT

In a circulation treatment system and method for treating a fountain solution the amounts of BOD, COD, n-hexane and SS are reduced in the fountain solution to recycle the fountain solution without draining it off. Circulation passages are connected to a vessel of a dampening section of an offset rotary press via communication passages, and circulate a fountain solution by introducing the fountain solution in the vessel from an introducing port and discharging the fountain solution from a discharging port. In the course of the circulation passages is a line pump for forcibly circulating the fountain solution, a potential absorption filtering device using an absorbing effect of a zeta potential, and an activated carbon filtering device using an absorbing effect of activated carbon. Fine particles of ink, paper, oil or similar materials contained in the fountain solution are first absorbed and removed by the potential absorption filtering device and then the fountain solution is decolorized and deodorized by the activated carbon filtering device.

5 Claims, 5 Drawing Sheets

CIRCULATION TREATMENT SYSTEM AND METHOD FOR TREATING FOUNTAIN SOLUTION

BACKGROUND OF THE INVENTION

1. Field of the Invention

The present invention relates to a circulation treatment system and method for a fountain solution used in offset printing.

2. Description of the Related Art

In offset printing, control of a fountain solution is essential. A fountain solution circulation system constantly supplies a clear fountain solution containing each ingredient at a respective predetermined concentration to a vessel in a printing unit at a regular flow rate and temperature, collects the fountain solution which has passed through the vessel to restore the fountain solution to be clear, and supplies the fountain solution to the vessel again. Most of the recent offset rotary presses employ continuous circulation systems for fountain solutions. In order to stabilize water intake, isopropyl alcohol (IPA) is used as an organic solvent.

The addition of IPA to a fountain solution decreases surface tension of the fountain solution and enables non-printing parts to be uniformly moistened with a small amount of fountain solution. Namely, IPA improves wettability of a plate surface, thereby maintaining printing quality. On the other hand, the use of IPA may cause some safety and health problems for workers. Therefore, the amount of IPA used is limited to as small an amount as possible, or a fountain solution which does not include any IPA is used. In any case, control of a fountain solution is becoming more important.

FIG. 5 is a flow diagram showing a fountain solution circulation system 101 of a prior art.

In FIG. 5, a raw fountain solution, water, an alcohol, etc. are mixed at precise proportions in a fountain solution mixer 102, and the mixed fresh fountain solution is supplied to the fountain solution circulation system 101. The fountain solution circulation system 101 removes contaminant in the fountain solution which has returned from a vessel 103 in a printing unit with a filtering device 104, and feeds solution back to a tank (not shown) inside the fountain solution circulation system 101.

When the level of the fountain solution in the tank lowers, a fresh fountain solution is added from the fountain solution mixer 102 through a float valve. The fountain solution in the tank is kept at a predetermined temperature by a cooling device (not shown). An alcohol concentration controller 106 controls the concentration of alcohol, which easily evaporates. The fountain solution in the tank is continuously fed into the alcohol concentration controller 106. The concentration of a hydrogen ion is detected by constantly monitoring the pH of the fountain solution, and the fountain solution is supplemented with a required amount of alcohol to keep the predetermined alcohol concentration.

When an etching solution is used as an alternative of IPA, it is also necessary to maintain the concentration and evaporation rate of the fountain solution by controlling the temperature and concentration. In the case of alcohol, the concentration is controlled using a hydrometer. On the other hand, in the case of an etching solution used as an alternative of IPA, the concentration can be controlled by use of the fact that the conductivity of a fountain solution is proportioned to the concentrations of an etching solution and a concentrated alkali solution. Sometimes organic substances generate in the fountain solution circulation system 101 and change the quality of the fountain solution. In addition, a fountain solution contains contaminant such as ink, paper particles and oil. Thus, it is important to keep the fountain solution circulation system 101 clean as a whole.

Nevertheless, in the above-described fountain solution circulation system 101 of the prior art, a porous filter material such as a sponge filter is used in the filtering device 104, which removes the contaminant of the fountain solution returned from the vessel 103 through a porous layer of the filter only by mechanical filtering. Accordingly, the ability of removing impurities in the fountain solution depends on the dimension of the pores of the filter and, normally, impurities having a diameter less than 100 $\mu$m cannot be removed.

If one tries to improve the ability of removing impurities by employing pores having a smaller dimension, a pressure posed on the fountain solution passing through a porous layer prevents the fountain solution from circulating at a predetermined flow rate. If the fountain solution does not circulate at a predetermined flow rate, the fountain solution loses normal functions, leading to deterioration of the printing quality. Furthermore, too small pores of the filter are easily clogged with impurities, which requires frequent maintenance of the filter.

The prior art fountain solution circulation system 101 has further disadvantages due to the limitation of the filtering ability. Specifically, after circulating a fountain solution in the system for a few months, the fountain solution is contaminated and decomposed, and the quality of the fountain solution finally changes to the extent that it cannot be used as a fountain solution. Then, the fountain solution needs to be replaced. In many cases, a discarded fountain solution which has only been filtered by conventional mechanical filtering cannot meet legal standards for drainage of wastewater in terms of a biochemical oxygen demand (BOD), chemical oxygen demand (COD), n-hexane concentration and suspended solid (SS). Thus, the discarded fountain solution is regarded as an industrial waste, and wastewater of a fountain solution cannot be directly drained into rivers or the like. As a result, such waste disposal is committed to specialist companies at considerable cost.

According to the present invention, provided are a circulation treatment system and method for a fountain solution wherein the amounts of a BOD, COD, n-hexane concentration and SS in a fountain solution are reduced without posing any pressure on the fountain solution, thereby recycling the fountain solution without draining off.

SUMMARY OF THE INVENTION

The circulation treatment system for a fountain solution of the present invention is a circulation treatment system for a fountain solution for circulating and purifying a fountain solution used in offset printing comprising a potential absorption filtering device using an absorbing effect of a zeta potential and an activated carbon filtering device using an absorbing effect of activated carbon, and the potential absorption filtering device and the activated carbon filtering device are provided in the course of a circulation passage for circulating the fountain solution.

Since fine particles of ink, paper, oil or the like generally have negative electric potentials, a potential absorption filter in a potential absorption filtering device is made to have a positive zeta potential. By this characteristic, it becomes possible to absorb fine particle foreign matter, which cannot be removed by a filter comprising a conventional porous filter material. Furthermore, by use of this potential absorption effect, fine particle foreign matter can be reduced without posing any pressure on a fountain solution passing through the potential absorption filter. In addition, a fountain solution can be decolorized and deodorized when passing through the activated carbon filter. Namely, amounts of a BOD, COD, n-hexane concentration and SS are reduced while maintaining a predetermined flow rate, and the decolorized and deodorized fountain solution can be used over a long period and recycled without the necessity of draining off. As a result, no wastewater is generated, and it is not necessary to commit the disposal of the wastewater to other companies, thereby reducing the running costs of a fountain solution used in offset printing. Moreover, offset printing using the thus purified fountain solution leads to improved printing quality.

Particularly, the system of the present invention may comprise a potential absorption filtering device disposed on the upstream side of a circulation passage and an activated carbon filtering device disposed on the downstream side of the circulation passage. By this arrangement, fine particles of ink, paper, oil or the like contained in a fountain solution are first removed by the potential absorption filtering device before passing through the activated carbon filtering device, thereby significantly extending life of an activated carbon filter in the activated carbon filtering device.

Preferably, the system of the present invention may further comprise a differential pressure gauge for detecting a differential pressure between a pressure at an introducing port of a circulation passage and a pressure at a discharging port of the circulation passage and an alarm device for giving an alarm in response to a result detected by the differential pressure gauge. A differential pressure between a pressure at an introducing port and a pressure at a discharging port is detected to give an alarm so that an operator is notified of the need for replacing a potential absorption filter and an activated carbon filter. Thus, a flow rate of a fountain solution is kept at a predetermined value, and an operator can easily control the fountain solution.

It is preferable that a differential pressure between a pressure at an introducing port of a circulation passage and a pressure at a discharging port of the circulation passage is 2.2 $kg/cm^2$ or less. Then, the flow rate of a fountain solution is optimum where a purifying effect by a potential absorption filtering device and an activated carbon filtering device can be most efficiently used, and the printing quality can be easily maintained. If a differential pressure is more than 2.2 $kg/cm^2$, a potential absorption filtering device or an activated carbon filtering device is clogged, which makes purification treatment insufficient.

A circulation treatment method for a fountain solution using a circulation treatment system of the present invention is a circulation treatment method for a fountain solution for circulating and purifying a fountain solution used in offset printing comprising the steps of filtering a fountain solution using an absorbing effect of a zeta potential and filtering the fountain solution using an absorbing effect of an activated carbon. By this method, fine particles of ink, paper, oil or the like contained in a fountain solution are absorbed and removed by a zeta potential, and the fountain solution is decolorized and purified by an activated carbon, enabling the fountain solution to be used almost indefinitely.

BRIEF DESCRIPTION OF THE DRAWINGS

FIG. 1 is a schematic view of a circulation treatment system for a fountain solution according to the present invention, wherein

DESCRIPTION OF THE PREFERRED EMBODIMENT

Figure 1A:
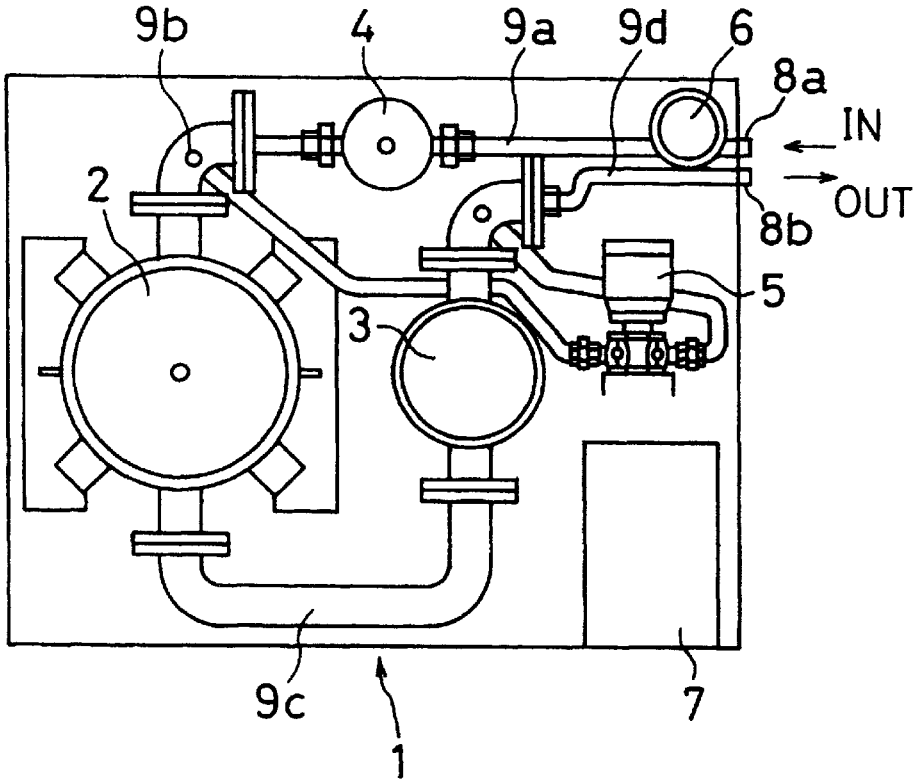
FIG. 1A is a plan view and FIG. 1B is a front view.
Figure 1B:
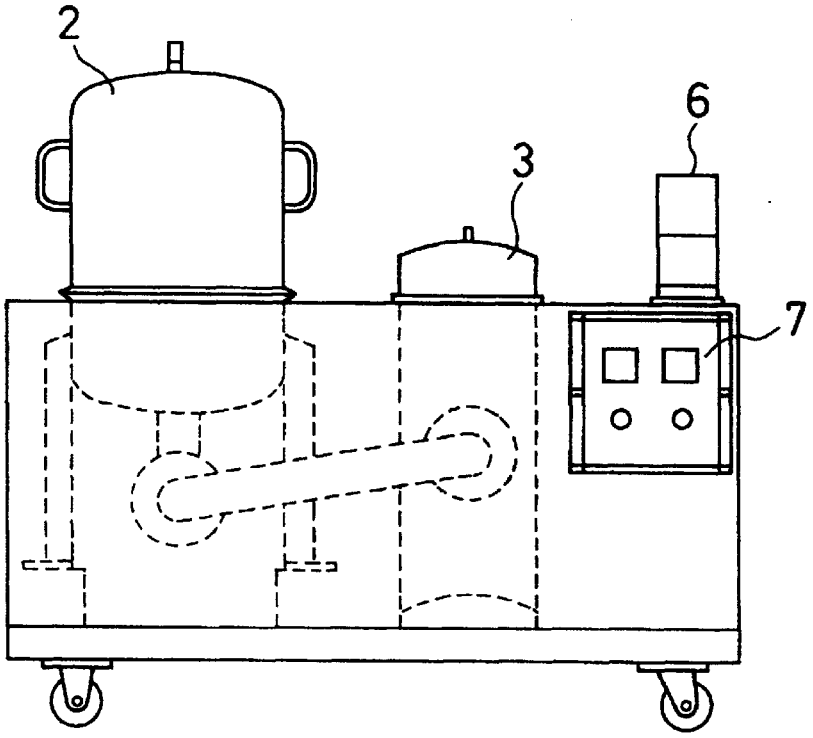
Figure 2:
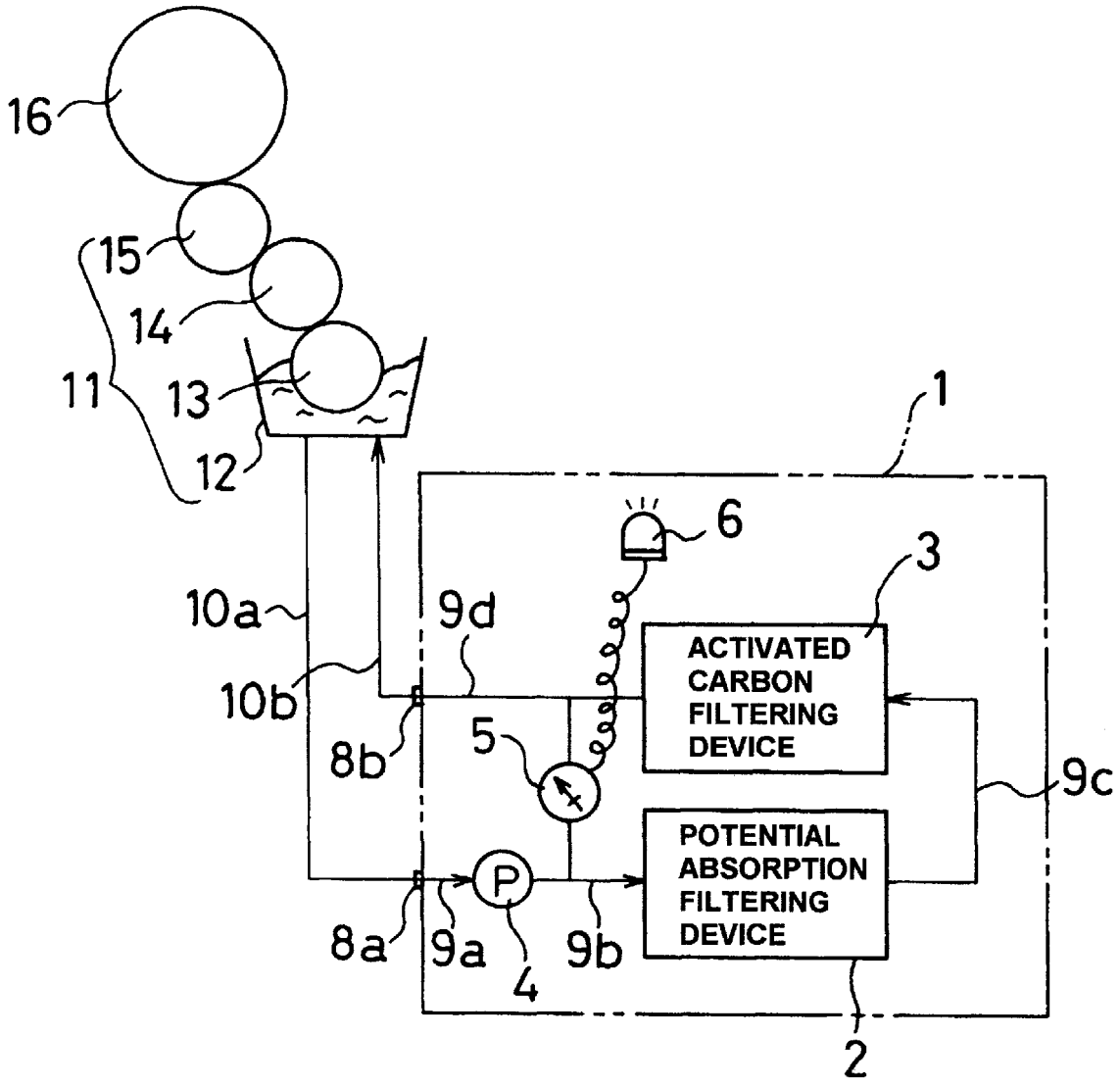
FIG. 2 is a flow diagram of the circulation treatment system for a fountain solution shown in FIG. 1.

FIG. 1 is a schematic view of a circulation treatment system for a fountain solution according to the present invention, wherein FIG. 1A is a plan view and FIG. 1B is a front view, and FIG. 2 is a flow diagram of the circulation treatment system for a fountain solution shown in FIG. 1.

A circulation treatment system for a fountain solution 1 in the embodiment of the present invention comprises circulation passages 9*a* to 9*d* for circulating a fountain solution used in an offset rotary press by introducing the fountain solution from an introducing port 8*a* (on the upstream side) and discharging the fountain solution from a discharging port 8*b* (on the downstream side), a line pump 4 as a pumping device for forcibly circulating the fountain solution, a potential absorption filtering device 2 using an absorbing effect of a zeta potential, and an activated carbon filtering device 3 using an absorbing effect of activated carbon; the line pump 4, the potential absorption filtering device 2 and the activated carbon filtering device 3 being disposed in the course of the circulation passages 9*a* to 9*d* in this order.

The circulation treatment system for a fountain solution 1 further comprises a differential pressure detecting transmitter 5 as a differential pressure gauge for detecting a differential pressure between a pressure in the circulation passage 9*b* which is outside the potential absorption filtering device 2 or on the side of the introducing port 8*a* and a pressure in the circulation passage 9*d* which is outside the activated carbon filtering device 3 or on the side of the discharging port 8*b* to transmit a detecting signal, a revolving light 6 as an alarm device for giving an alarm in response to a detected level of the detecting signal, and a control panel 7 for controlling the line pump 4, the differential pressure detecting transmitter 5 and the revolving light 6.

Figure 3:
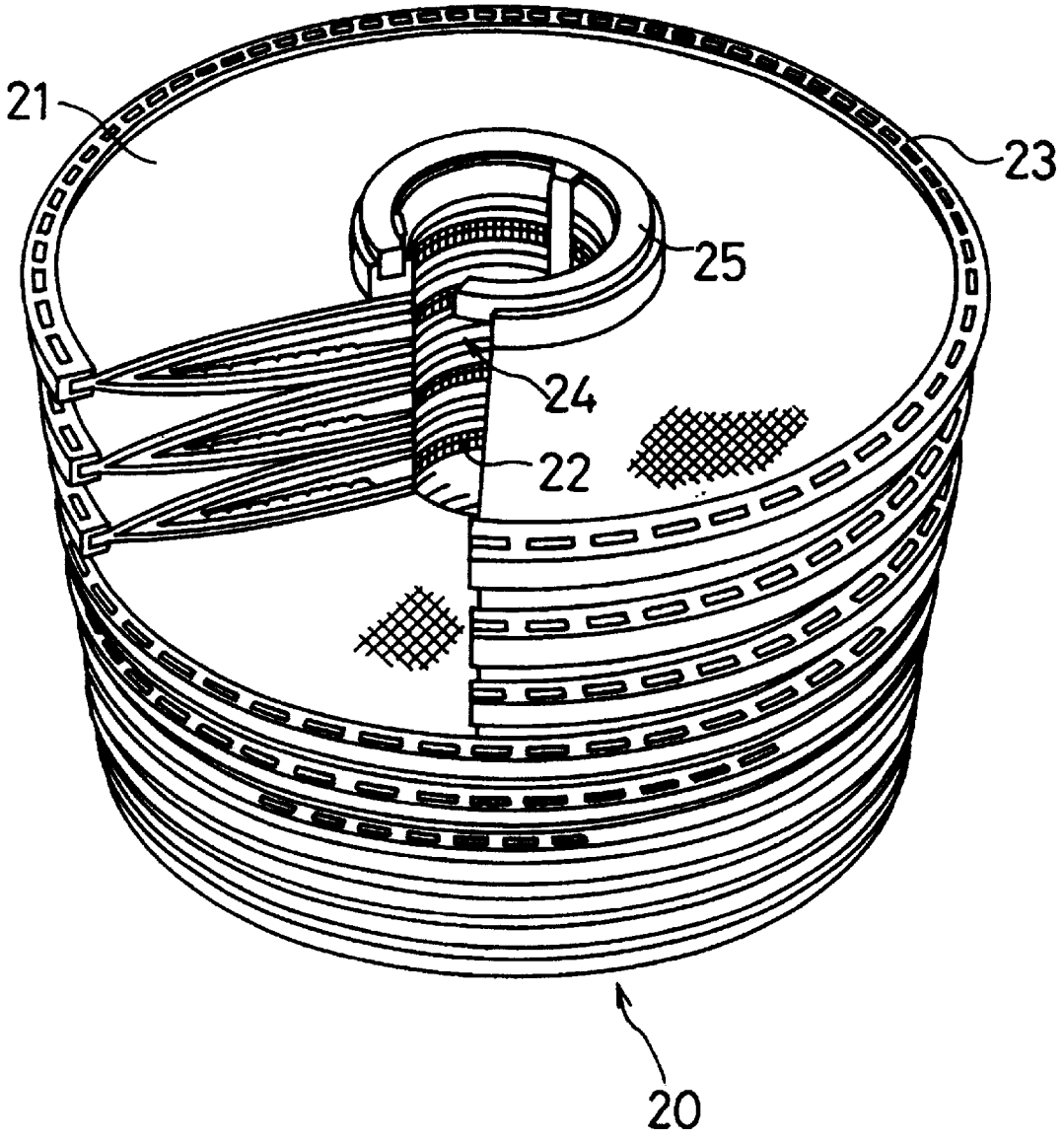
FIG. 3 is a partly cut out detailed view of a potential absorption cartridge enclosed in a housing of a potential absorption filtering device shown in FIG. 1.

FIG. 3 is a partly cut out detailed view of a potential absorption cartridge enclosed in a housing of the potential absorption filtering device shown in FIG. 1.

The potential absorption filtering device 2 encloses a potential absorption cartridge 20 as a replaceable potential absorption filter within a housing. The potential absorption cartridge 20 is composed of a plurality of cells each of which comprises a medium 21 mainly made of resin and cellulose, a polypropylene separator 22 and an edge seal 23. The cells are layered so as to sandwich a polypropylene ring seal 24 and assembled with a polypropylene core 25.

Generally, a potential difference is generated on an interface between different phases. A potential caused by an electric double layer which is generated on an interface of a particle has a portion which does not play a dynamic role (fixed bed) and a portion which plays a dynamic role (diffusion layer). The electric phenomenon which occurs between different phases only when there is a relative motion is called an electrokinetic phenomenon, and the potential existing therein is called a zeta potential.

A zeta potential, as well as a Tyndall effect and a Brownian movement, is a physical phenomenon due to a characteristic of fine particles. In general, fine particles and microorganisms in a fluid have a negative potential. Similarly, fine particles of ink, paper, oil or the like contained in a fountain solution have a negative potential. To the contrary, the medium 21 in the potential absorption filtering device 2 characteristically has a positive zeta potential, and therefore can absorb and remove these fine particles which cannot be removed with a conventional 0.2 $\mu$m-membrane filter. Furthermore, by using the above potential absorption effect, fine particle foreign matter can be removed without posing any pressure on a fountain solution passing through the potential absorption filtering device 2.

Figure 4:
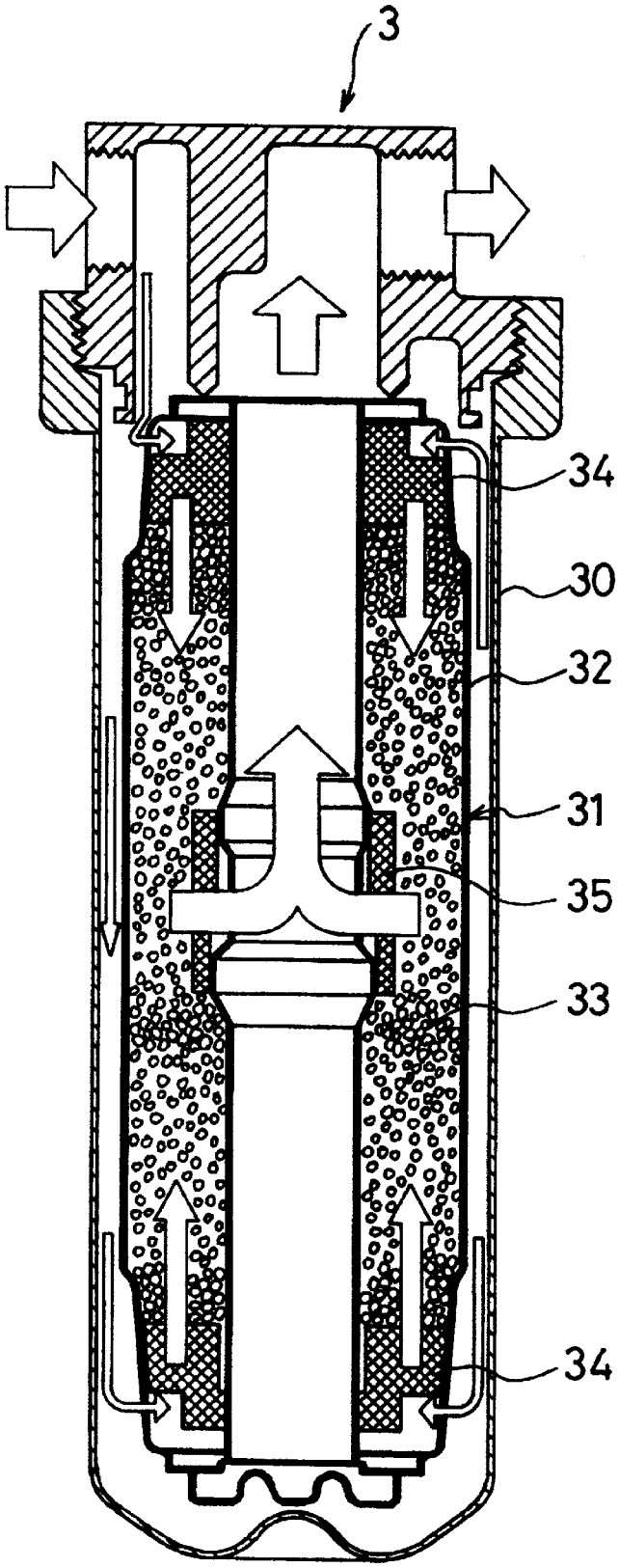
FIG. 4 is a longitudinal sectional detailed view of an activated carbon filtering device shown in FIG. 1.
Figure 5:
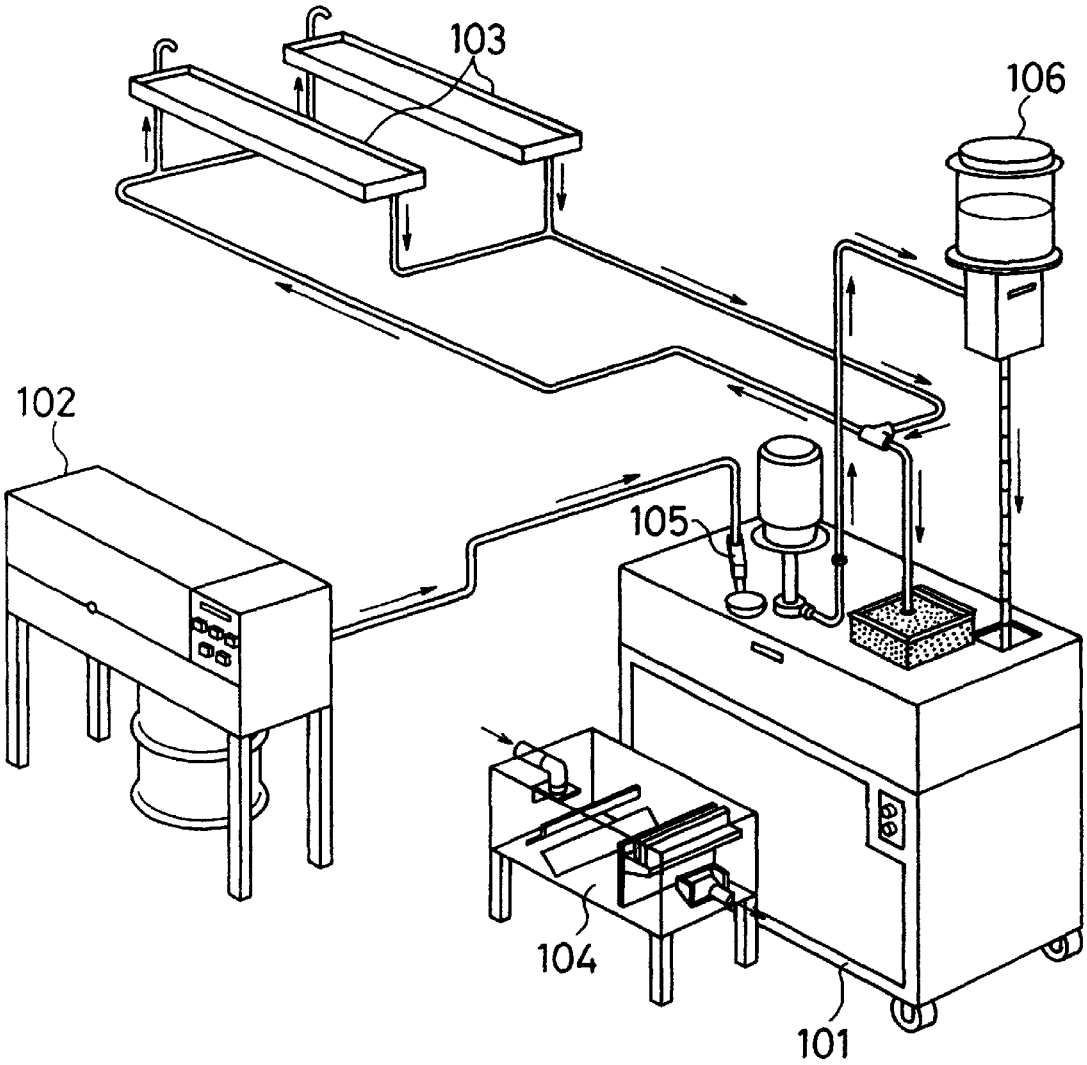
FIG. 5 PRIOR ART
FIG. 5 is a flow diagram illustrating a circulation treatment system for a fountain solution of a prior art.

FIG. 4 is a longitudinal sectional detailed view of an activated carbon filtering device shown in FIG. 1. An arrow in FIG. 4 indicates a flow of a fountain solution. The activated carbon filtering device 3 encloses an activated carbon cartridge 31 as a replaceable activated carbon filter in a housing 30. The activated carbon cartridge 31 comprises activated carbon of coconut husk 33, pre filter 34 and post filter 35 contained and heat-sealed in a polypropylene nonwoven fabric 32.

The activated carbon of coconut husk 33 is hard grainy activated carbon of high quality and capable of effectively absorbing organic substances, color, odor and impurities from a fountain solution. The pre filter 34 and post filter 35 are made of cellulose fibers and melamine resin. The pre filter 34 absorbs precipitates such as dirt, rust and others, and the post filter 35 prevents the activated carbon of coconut husk 33 from flowing out. The fountain solution is filtered by the pre filter 34, and organic substances or the like in the fountain solution are absorbed by the activated carbon of coconut husk 33.

A dampening section 11 of an offset rotary press is provided on a plate 16 and comprises a vessel 12 and a plurality of rollers 13, 14 and 15 arranged toward the plate 16 in this order. As shown in FIG. 2, the circulation treatment system for a fountain solution 1 is connected to the vessel 12 in the dampening section 11 of the offset rotary press through connection passages 10*a* and 10*b*. The connection passages 10*a* and 10*b* are connected to the circulation treatment system for a fountain solution 1 via the introducing port 8*a* and the discharging port 8*b*, respectively. The fountain solution in the vessel 12 circulates through the connection passage 10*a*, the circulation passages 9*a* to 9*d* and the connection passage 10*b* in succession.

The fountain solution in the vessel 12 is forcibly fed into the circulation passage 9*a* by the line pump 4. The fountain solution in the vessel 12 which is introduced into the circulation passage 9*a* from the connection passage 10*a* via the introducing port 8*a* is led into the potential absorption filtering device 2 passing through the circulation passage 9*b*. In the potential absorption filtering device 2, fine particles of ink, paper and oil or the like contained in the fountain solution are absorbed and removed by an absorbing effect of a zeta potential. By absorbing and removing the fine particle foreign matter using the absorbing effect of the potential, the fine particle foreign matter can be removed without posing any pressure on the fountain solution passing through the potential absorption filtering device 2. Furthermore, the fountain solution led to the activated carbon filtering device 3 via the circulation passage 9c is decolorized and deodorized, and is returned into the vessel 12 through the circulation passage 9*d* and the connection passage 10*b*.

According to the above process, the amounts of a BOD, COD, n-hexane concentration and SS are reduced while keeping a predetermined flow rate by the potential absorption filtering device 2 and the activated carbon filtering device 3 provided in the course of the circulation passages 9*a* to 9*d*. Furthermore, the decolorized and deodorized fountain solution can be used over a long period and recycled without draining off. As a result, no wastewater of the fountain solution is generated, and thus it is not necessary to commit the disposal of wastewater to other companies, thereby reducing the running costs of a fountain solution used in offset printing. In addition, use of the thus purified fountain solution in offset printing improves printing quality.

In particular, since the circulation treatment system for a fountain solution 1 of the above-described embodiment has such a structure that the potential absorption filtering device 2 is disposed on the upstream side of the circulation passages 9*a* to 9*b* and the activated carbon filtering device 3 on the downstream side, fine particles of ink, paper, oil or the like contained in a fountain solution are first removed by the potential absorption filtering device 2 and then the fountain solution passes through the activated carbon filtering device 3. Accordingly, life of the activated carbon cartridge is significantly extended.

The differential pressure detecting transmitter 5 provided in the circulation treatment system for a fountain solution 1 of the present invention detects a differential pressure between pressures at the circulation passages 9*b* and 9*d*, and turns on the revolving light 6 to give an alarm when the differential pressure is over 2.2 kg/cm$^2$. The differential pressure detecting transmitter 5 detects a sharp rise in the differential pressure in the medium 21 in the potential absorption filtering device 2 which occurs when the absorbing ability reaches the limit, and notifies an operator of timing for replacement of the potential absorption filtering device 2, thereby keeping a flow rate of a fountain solution at a predetermined value. In the activated carbon filtering device 3, the limit of the absorbing ability is detected from a rise in a differential pressure as well.

What is claimed is:

1. In a fountain solution circulation system of an offset printing press, the improvement comprising a potential absorption filtering device using an absorbing effect of a zeta potential and an activated carbon filtering device using an absorbing effect of activated carbon, said potential absorption filtering device being disposed on an upstream side of a circulation passage and said activated carbon filtering device being disposed on a downstream side of said circulation passage.

2. The fountain solution circulation system according to claim 1, wherein the improvement further comprises a differential pressure detecting device for detecting a differential pressure between a pressure on a side of an introducing port of said circulation passage and a pressure on a side of a discharging port of said circulation passage and an alarming device for giving an alarm in response to a result detected by said differential pressure detecting device.

3. The fountain solution circulation system according to claim 1, wherein the improvement further comprises a differential pressure detecting device for detecting a differential pressure between a pressure on a side of an introducing port of said circulation passage and a pressure on a side of a discharging port of said circulation passage and an alarming device for giving an alarm in response to a result detected by said differential pressure detecting device.

4. In a method of treating a fountain solution of an offset printing press wherein the fountain solution is circulated and purified, the improvement comprising:

filtering said fountain solution by an absorbing effect of a zeta potential, and filtering said fountain solution by an absorbing effect of activated carbon after filtering said fountain solution by the absorbing effect of the zeta potential.

5. The method of treating a fountain solution of an offset printing press according to claim 4, wherein a differential pressure between a pressure on a side of an introducing port of a circulation passage for circulating said fountain solution and a pressure on a side of a discharging port of the circulation passage is 2.2 $kg/cm^2$ or less.

* * * * *